US006244053B1

(12) United States Patent
Gulati et al.

(10) Patent No.: US 6,244,053 B1
(45) Date of Patent: Jun. 12, 2001

(54) SYSTEM AND METHOD FOR TRANSFERRING CRYOGENIC FLUIDS

(75) Inventors: Kailash Chandler Gulati, Dallas; John J. Buckles, Plano, both of TX (US)

(73) Assignee: Mobil Oil Corporation, Fairfax, VI (US)

( * ) Notice: Subject to any disclaimer, the term of this patent is extended or adjusted under 35 U.S.C. 154(b) by 0 days.

(21) Appl. No.: 09/513,707

(22) Filed: Feb. 25, 2000

Related U.S. Application Data

(60) Provisional application No. 60/120,229, filed on Mar. 8, 1999.

(51) Int. Cl.[7] ..... F25B 19/00
(52) U.S. Cl. ..... 62/50.1; 62/50.7
(58) Field of Search ..... 62/50.1, 50.7

(56) References Cited

U.S. PATENT DOCUMENTS

| | | | | |
|---|---|---|---|---|
| 2,487,863 | * | 11/1949 | Garretson | 62/50.1 |
| 4,014,369 | | 3/1977 | Kobres, Jr. | 138/112 |
| 4,315,408 | | 2/1982 | Karl | 138/112 |
| 5,127,230 | * | 7/1992 | Neeser et al. | 62/50.1 |
| 5,400,602 | | 3/1995 | Chang et al. | 62/50.7 |
| 5,421,160 | * | 6/1995 | Gustafson et al. | 62/50.1 |
| 5,421,162 | * | 6/1995 | Gustafson et al. | 62/50.1 |
| 6,012,292 | | 1/2000 | Gulati et al. | 62/50.7 |

* cited by examiner

*Primary Examiner*—Ronald Capossela

(57) ABSTRACT

A system and a method for transferring cryogenic fluids (LNG) between a first LNG storage tank and a second LNG storage tank wherein the transfer system includes a means for cooling the transfer lines when the system is not in use. The system has two transfer lines which extend between the tanks and which are fluidly connected together to form a closed loop when the system is not in use. LNG is circulated at high pressure through the closed loop during idle intervals to keep the lines at a temperature at which LNG will remain in a single phase, i.e. liquid.

13 Claims, 3 Drawing Sheets

SYSTEM AND METHOD FOR TRANSFERRING CRYOGENIC FLUIDS

CROSS-REFERENCE TO EARLIER APPLICATION

The present application claims the priority of Provisional Patent Application Ser. No. 60/120,229, filed Mar. 8, 1999.

DESCRIPTION

1. Technical Field

The present invention relates to a system and method for transferring cryogenic liquids and in one aspect relates to a system and method for transferring cryogenic liquids such as liquefied natural gas (LNG) between an offshore receiving/loading station and an onshore import/export facility wherein the system includes a means for maintaining the temperature within the transfer line of the system low enough to prevent cryogenic liquid from gasifying and forming a two-phase fluid within the transfer line during idle periods between two consecutive unloading/loadings.

2. Background

Large volumes of natural gas (comprised mostly of methane) are produced in many remote areas of the world. This gas has significant value if it can be economically transported to market. Where the production area is in reasonable proximity to the market and the terrain permits, the gas can be transported through submerged and/or land-based pipelines. However, where the gas is produced in locations where laying a pipeline is infeasible or is economically prohibitive, other techniques must be used to get this gas to market.

Probably the most commonly used of these techniques involves liquefying the gas on site and then transporting the liquefied natural gas or "LNG" to market in specially-designed, storage tanks aboard sea-going vessels. To form LNG, natural gas is compressed and cooled to cryogenic temperatures (e.g. −160° C.) to convert it to its liquid phase, thereby substantially increasing the amount of gas which can be carried in the storage tanks. Once the vessel reaches its destination, the LNG is off-loaded through a transfer line into onshore storage tanks from which the LNG can then be revaporized as needed and transported on to end users through pipelines or the like.

At a typical LNG terminal, the storage tanks may be located from 100 to 500 meters from the moored vessel. Thus, transfer lines having lengths of one-half kilometer or more are not uncommon and at one known terminal, a transfer line of about 3.5 kilometers in length has actually been used to load LNG onto transport vessels.

In both loading onto and off-loading LNG from a vessel, it is vitally important that the transfer line is one which is capable of being pre-cooled to cryogenic temperatures before a loading/off-loading operation is commenced so that the stresses and strains of the cool-down operation can be avoided during an actual LNG transfer operation and so that excessive amounts of the LNG will not vaporize within the transfer line and overwhelm the boil-off gas handling system during the early stages of loading/off-loading. That is, before commencing a loading/off-loading operation, the transfer line must be cooled from ambient temperature to a cryogenic temperature of about 110° K. to prevent the formation of excessive amounts of gas in the transfer line.

Due to technical reasons, it is now common practice to cool the transfer line to the necessary cryogenic temperature before its initial use and then maintain it at that temperature at all times thereafter without ever allowing the temperatures in the line to rise above a certain cold temperature. That is, for LNG transfer lines, not only is the transfer line maintained at a certain cryogenic temperature, e.g. approximately 110° K., before and during the transfer operation but also during the idle intervals between transfer operations; i.e. those time intervals which exist between the completion of one loading/off-loading operation and the commencement of another.

Depending on demand, these idle intervals may be relatively long in length. For example, at some terminals only one or two LNG transport vessel may arrive each week. Since the loading/unloading operation is normally completed within about twelve hours, a particular transfer line may only be in active use from about twelve to about twenty-four hours during any one week. Thus, a transfer line may have to be maintained at a cryogenic temperature for a whole week even though the line will only be used sporadically for a short time and will remain idle the rest of the time.

As will be understood by those skilled in this art, it is necessary to avoid repeated warming of the transfer line during these idle intervals since the line would have to be "re-cooled" before each transfer operation. This would be very time consuming which would result in substantial delays in loading/off-loading a transport vessel which, in turn, would significantly increase the costs in transporting the LNG. Further, any repeated warming and cooling of the line induces stresses in the line which are likely to cause early failure of the transfer system.

In known prior art LNG transfer systems of this type, the transfer line is initially cooled and maintained at cryogenic temperatures by installing two parallel lines which extend between a storage tank on shore and an offshore facility for mooring a LNG transport vessel. During a transfer operation (e.g. off-loading), the two parallel lines operate in unison, both delivering LNG from the transport vessel to the storage tank onshore. Upon conclusion of the off-loading operation, the two lines are fluidly coupled together at the offshore mooring facility to form a continuous line having both its inlet and its outlet in the onshore storage tank. Circulation pumps, normally installed inside the onshore storage tank, pick up LNG from within the tank, pressurize it, and pump it through the inlet of the continuous line. The LNG travels from the storage tank to the mooring facility through one of the parallel lines and returns to the tank through the other.

Heat leaking into the lines and energy input from the circulating pumps will cause the temperature in the parallel lines to rise thereby warming the LNG in the lines. This, in turn, results in the partial gasification of the LNG thereby creating undesirable, two-phase flow in at least portions of the lines which, in turn, puts severe limitations on the design and operation of the transfer lines.

To alleviate this problem, typically, both of the parallel lines are insulated to minimize heat leak into the lines. While heavily insulated lines work relatively well where relative short transfer distances are involved, they experience severe drawbacks when used to transfer LNG over longer distances. For example, in the terminal where the transfer line was approximately 3.5 kilometers long, the flow rates required to maintain the desired cryogenic temperature were approximately three times as much as required in other typical LNG terminals having shorter transfer lines (e.g. 100 to 500 meters). Such high flow rates are uneconomical, making cooling of the transfer line during idle intervals impractical for these relatively long length of line.

Recently, transfer systems have been proposed for use in LNG terminals where the transport vessel will be moored offshore at significantly greater distances (e.g. up to 6 kilometers) than are now common. For example, in U.S. Pat. No. 6,012,292, issued Jan. 11. 2000, a transfer system is disclosed wherein the transfer line is constructed by placing the return line inside the main transfer line, thereby greatly improving the insulative properties of the lines which, in turn, substantially reduces the amount of two-phase flow in the longer pipeline. However, there still exists a need to reduce even further the degree of vaporization of LNG in the transfer line, especially as the lengths of these lines continue to increase.

SUMMARY OF THE INVENTION

The present invention provides a system and a method for transferring cryogenic fluids (LNG) between a first point (a first LNG storage tank aboard a sea-going vessel) and a second point (a second LNG storage tank located on shore) wherein the transfer system includes a means for cooling the transfer lines when the system is not in use and no cryogenic fluids are being transferred between the tanks. Basically, the system comprises two transfer lines which extend between the first tank and second tank.

In a normal loading/off-loading operation, the cryogenic fluid will be pumped from the first tank to the second tank through both of the transfer lines similarly as is done in prior art transfer systems of this type. However, in the present invention, the respective ends of the two transfer lines are fluidly connected together to form a closed loop when the system is not in use and a cryogenic liquid (LNG) is circulated under pressure to keep the lines at a temperature at which the circulating cryogenic fluid will remain in a single phase, i.e. liquid.

The closed loop is formed by fluidly connecting the respective ends of the two transfer lines together at the first tank by a conduit. The other ends of the transfer lines are fluidly connected together at the second tank through a flowpath which includes a first, high backpressure, low flow rate pump and a heat exchanger. The first circulating pump pressurizes the LNG to a relatively high pressure (e.g. 10 bar) before it passes the pressurized LNG through the heat exchanger which, in turn, cools the pressurized LNG. The heat exchange is positioned within the second storage tank and is in contact with LNG stored therein which, in turn, acts as the coolant for the heat exchanger.

Circulation of the cooled LNG is continued through the closed loop during most of the idle interval that the system is not in use and no transfer operation is being carried out. A short time (e.g. 2–3 hours) before the next transfer operation is to be commenced (e.g. arrival of the next LNG transport vessel), the circulation of the LNG within the closed loop can be switched off and cooling with a second low backpressure, high flow rate pump is commenced to further lower the temperature of the transfer lines before the transfer operation is commenced.

Advantages derived from the present invention are significant. By maintaining the circulating LNG in the transfer lines at a high pressure (e.g. about 10 bar or more) during the idle intervals, the lines can remain at a temperature considerably above the nominal bubble point temperature of LNG (e.g. 110° K) typically considered necessary for conventional transfer lines operated at a much lower pressure (e.g. 1 bar). By reducing temperature differential between the line temperature and the ambient, there will be a reduction in the heat flow into the transfer lines

BRIEF DESCRIPTION OF THE DRAWINGS

The actual construction operation, and apparent advantages of the present invention will be better understood by referring to the drawings, not necessarily to scale, in which like numerals identify like parts and in which.

BEST KNOWN MODE FOR CARRYING OUT THE INVENTION

Figure 1:
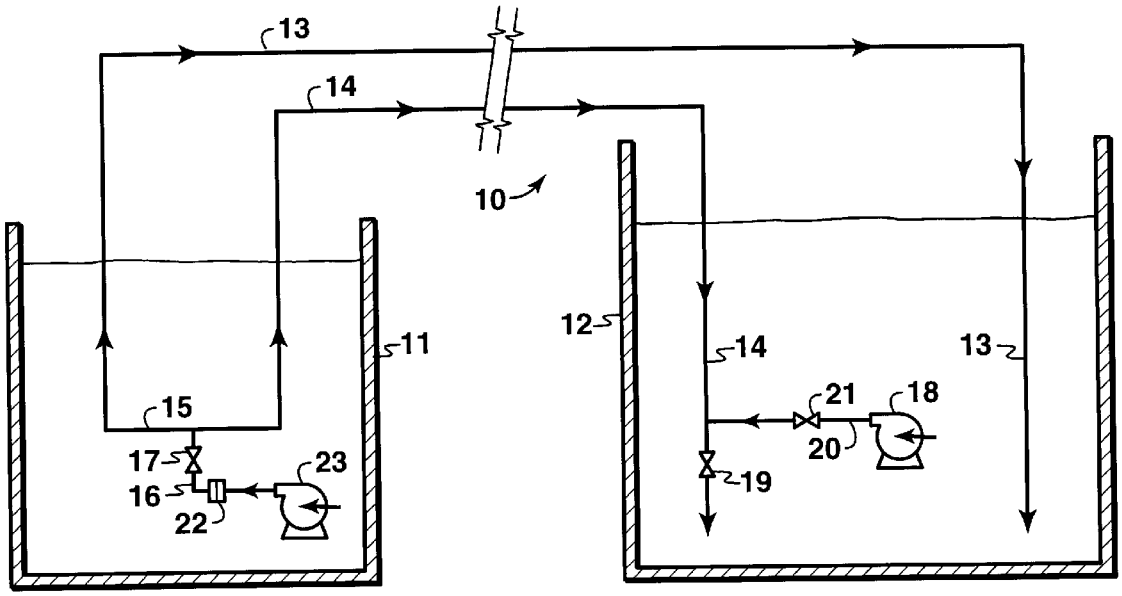
FIG. 1 (PRIOR ART)
FIG. 1 is a schematic illustration of a typical prior art, transfer line system for transferring cryogenic fluids during a transfer operation.

Referring more particularly to the drawings, FIG. 1 schematically illustrates a typical prior art, transfer system 10 for transferring a cryogenic fluid (e.g. liquefied natural gas, "LNG") from a first point (e.g. storage tank 11 aboard a tanker, not shown) to an second point (e.g. storage tank 12 on shore at a LNG terminal). As will be understood in the art, tank 11 may be one of several such tanks on a sea-going transport vessel which, in turn, is moored to a loading/off-loading structure which is positioned some distance offshore. Once the vessel is properly moored, the transfer system 10 is then hooked up and the transfer operation (e.g. an off-loading operation is shown in the FIGS.) is commenced.

The typical, prior art transfer system 10 is comprised of two parallel lines 13 (e.g. a return line) and 14 (e.g. main transfer line), both of which extend between offshore tank 11 and onshore tank 12. These lines can be separate or one line can lie within the other, see U.S. Pat. No. 6,012,292, issued Jan. 11, 2000, and which is incorporated in its entirety herein by reference. The first end of each of lines 13, 14 which lie within tank 11 are fluidly connected together by a conduit 15 which, in turn, has an inlet line 16 fluidly connected thereto. A valve 17 is positioned in inlet line 16 to control flow therethrough. The other ends of lines 13 and 14 lie within onshore tank 12. A first low backpressure, high flow rate circulating pump 18 is connected to one of the lines (e.g. line 14) upstream of valve 19 by line 20 which, in turn, has valve 21 therein for a purpose described below.

When a transfer operation (e.g. off-loading tank 11) is to be carried out, a vessel is moored to an offshore structure and inlet line 16 of transfer system 10 is connected by coupling 22 or the like to the outlet of pump transfer 23. Valves 17 and 19 are opened and valve 21 is closed and transfer pump 23 is started to pump LNG from tank 11 to tank 12 through both of the lines 13, 14. That is, both lines 13 and 14 act in unison, i.e. both carry LNG in the same direction from the tank 11 on the transport vessel to the shore-based tank 12.

However, before commencing an off-loading operation, the transfer system 10 has to be cooled from ambient temperature to a cryogenic temperature of approximately 110° K. and must be maintained at that temperature during idle intervals when no transfer operation is being carried out.

It is common practice to cool the transfer system before its initial use and then keep it at that temperature at all times thereafter. Thus the system 10 must be maintained at this low temperature even though the system may only be in use for short periods (e.g. 12–24 hours) during any one week. Loading of LNG onto a transport vessel is similar in arrangement except that a set of loading pumps (not shown) in the shore-based tank 12 are operational and the LNG is flowed through both lines 13, 14 towards tank 11 in the vessel.

Figure 2:
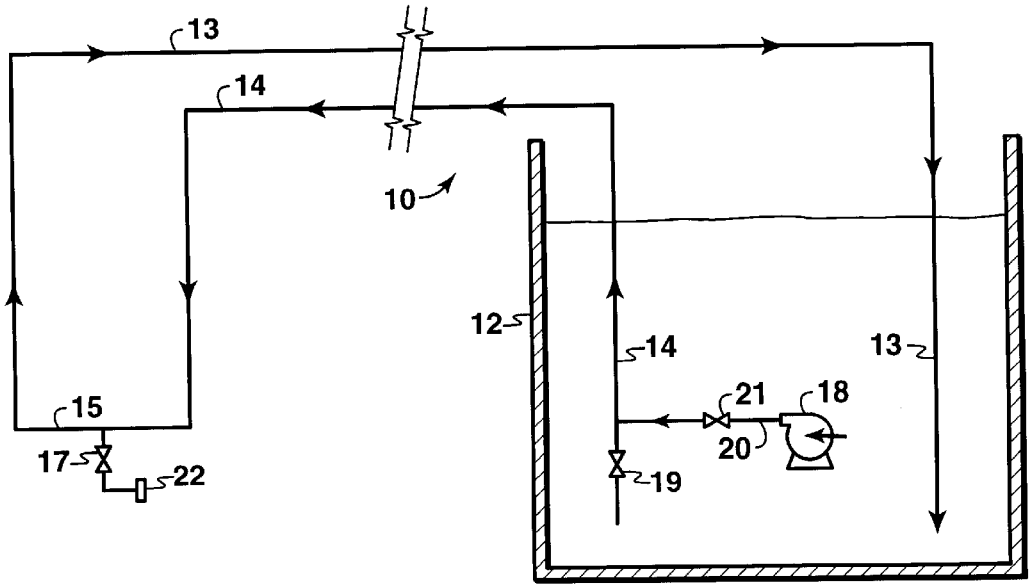
FIG. 2 (PRIOR ART)
FIG. 2 is a schematic illustration of the typical prior art, transfer line system of FIG. 1 during an idle interval.

To effect the initial cooling of system 10 and/or to maintain the system at a cryogenic temperature once coupling 22 on inlet line 16 has been disconnected from transfer pump 23 on a transport vessel (FIG. 2), valves 17 and 19 are closed and valve 21 is opened. Circulation pump(s), normally installed inside the storage tank, pick LNG from tank 12, pressurize and inject it into one end of line 14. This LNG is circulated through the open loop formed by line 14, connecting line 15, and return line 13 and back to originating tank 12 where it exits into the tank through the open end of line 13.

As the LNG travels through the length of this loop, the heat which inherently leaks into the lines and the energy which is inputted into the LNG by the circulating pump 18 cause the LNG to warm up thereby causing partial gasification of the LNG as it circulates through the transfer system 10. Due to this partial gasification, a two-phase fluid flow (i.e., liquid and gas) will exist in at least some portions of the transfer system. This puts severe limitations on the transfer system's design and operation. To prevent excessive gasification, the LNG is normally circulated at relatively high flow rates during idle periods of the transfer line operation.

With the heavily insulated transfer lines, the system 10 described above works well as long as the length of the lines are relatively short, e.g., 1-km or less. For longer transfer lines, LNG flow rates must be increased even more, requiring larger pumps and resulting in excessive boil-off in the circulating lines. For example, at a known terminal, to keep the 3.5-km transfer lines at the desired cryogenic temperature, the flow rates must be approximately three times as much as that required at other typical terminals having shorter transfer lines. This is at the very least uneconomic and may become technically infeasible as the length of transfer lines continue to increase.

An ideal transfer system would have no boil-off (i.e. gasification) at all wherein the LNG that flows through it during idle intervals would always be in the single phase (i.e. liquid regime). This is the object of the present invention wherein the LNG used for cooling the transfer system circulates through a closed loop under high pressure, e.g., 10 Bar, and is supercooled to the normal temperature of LNG in the onshore storage tank as it continues to circulate therethrough.

Figure 5:
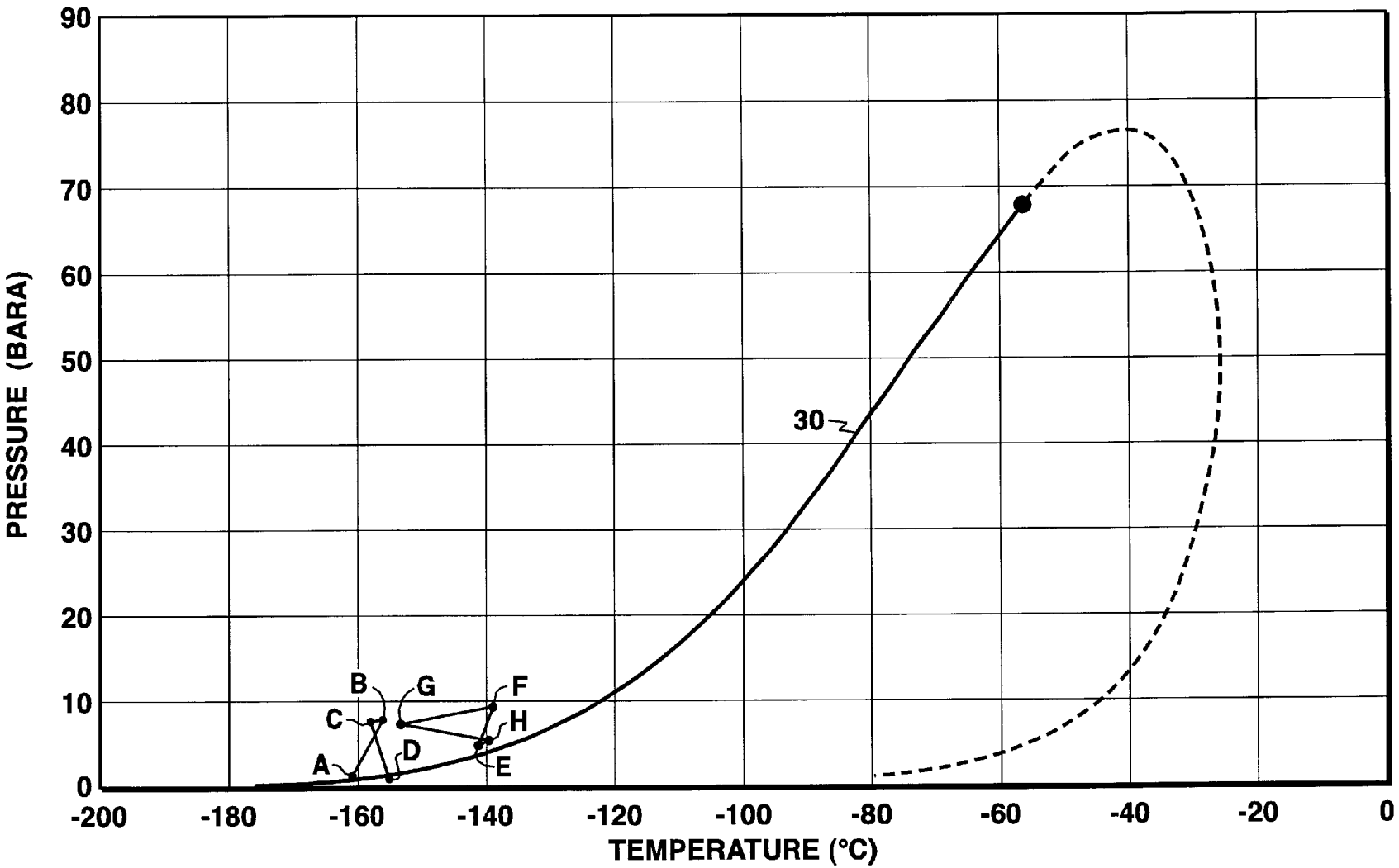
FIG. 5 is a temperature-pressure graph with the phase boundaries of a typical LNG composition thereon comparing the pressures and temperatures of the LNG as it circulated through a typical prior art transfer line system to the pressures and temperatures of the same LNG composition being circulated through the transfer line system of the present invention.

FIG. 5 graphically illustrates how the present invention differs from the prior art transfer systems. Normally, LNG at the bottom of storage tank 12, where circulation pump(s) 18 is located, may be assumed to be at near atmospheric pressure (worst condition for system design) and at a temperature of approximately −162° C. (111° K); this being at the bubble point line 30 (FIG. 5) of this particular LNG composition at near atmospheric pressure. Conventional, prior art circulation pump(s) 18 pick up LNG from tank 12 at its inlet (point "A" on graph in FIG. 5) and pressurizes it to point "B"(i.e. outlet of pump 18). It slightly cools to point "C"(i.e. surface of LNG in tank 12)before it is circulated through the open loop shown in FIG. 2 to be returned into tank 12 at point "D"(i.e. where returning fluid enters LNG in tank 12) which is at a pressure and temperature which lie within the two-phase (i.e. liquid and gas) region below the bubble point line 30. While the pump(s) 18 pressurize the LNG sufficiently to create the desired flow rate through the transfer system 10, it does not pressurize the LNG sufficiently to prevent the formation of two-phase fluid in the loop.

Figure 3:
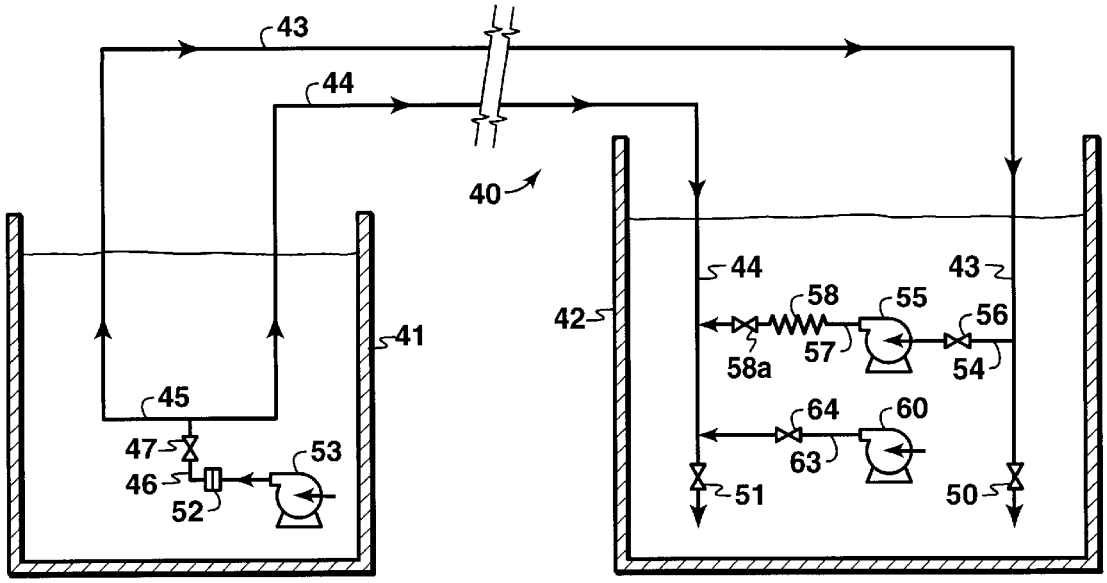
FIG. 3 is a schematic illustration of the transfer line system of the present invention during a LNG transfer operation.
Figure 4:
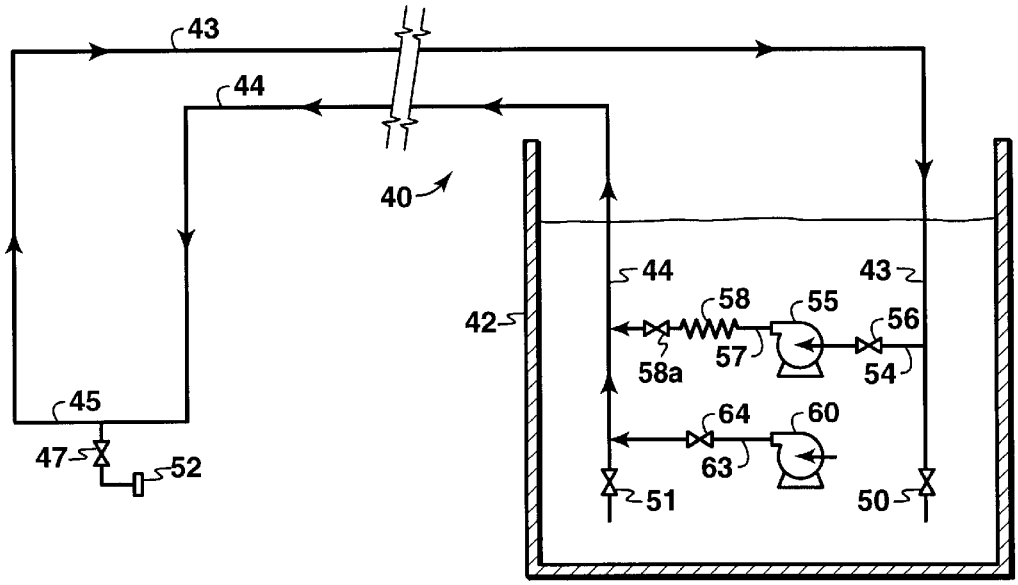
FIG. 4 is a schematic illustration of the transfer line of the present invention during an idle interval, i.e. an interval between two successive unloading/loading operations.

Now referring to FIGS. 3 and 4, the transfer system 40 of the present invention is comprised of two parallel lines 43 (e.g. a return line) and 44 (e.g. main transfer line), both of which extend between a first point (e.g. offshore tank 41 on a vessel or the like) and a second point (e.g. onshore tank 42). Again, these lines can be separate or one line can lie within the other, see U.S. Pat. No. 6,012,292, issued Jan. 11, 2000. The first end of each of the lines 43, 44 which lie within tank 41 are fluidly connected together by conduit 45 which, in turn, has an inlet line 46 fluidly connected thereto. A valve 47 is positioned in inlet line 46 to control flow therethrough. The other ends of lines 43 and 44 lie within onshore tank 42 and are controlled by valves 50, 51, respectively.

The inlet of a high-pressure, low flow first circulating pump 55 is connected to one of the transfer lines (e.g. return line 43) upstream of valve 50 by line 54 which has a flow control valve 56 therein. Valve 56 can act as a "throttle" valve to control the backpressure to pump 55 or a separate backpressure valve (not shown) can be positioned upstream of pump 55. The outlet of pump 55 is connected to the other transfer line (e.g. main transfer line 44 by line 57 which, in turn, has a heat exchanger 58 and a flow-control valve 58*a* therein. A low back-pressure, high flow second circulating pump 60 has its inlet within tank 42 and its outlet connected to main transfer line 44 by line 63 and valve 64.

To off-load LNG from a tank 41, transfer system 40 is connected by coupling 52 to a transfer pump 53 within tank 41. With valves 47, 51, 50 open and valves 56, 58*a*, and 64 closed, pump 53 is started to thereby pump the LNG from tank 41 through both lines 43 and 44 into tank 42. During this operation, circulation pumps 55 and 60 are not working. Once the off-loading operation is completed, transfer system 40 is disconnected from the vessel and must be cooled while waiting on another vessel.

While the unloading operation of the present invention is similar to the conventional unloading operation described, the cooling of the system 40 during an idle interval, i.e. during the idle period between two consecutive unloading/loading operations, is completely different since in the present invention for a majority of the time, LNG is circulated through the transfer lines in a closed loop arrangement under high pressure. This is achieved by closing valves 47, 50, 51, and 64, opening valves 58*a* and 56 and starting the high backpressure, low flow pump 55. Depending on transfer line design, e.g., the line length, line diameter and design temperature conditions, the back-pressure and flow rate will be determined such that as the LNG in the closed loop system enters pump 55 at point E (FIG. 5), it is well above the bubble point curve 30 and will remain above curve 30 throughout circulation through the closed loop.

In the closed loop circulation transfer system 40 of the present invention, scheme, first circulation pump 55 first pressurizes LNG from tank 42 to high pressure, say, 10-bar absolute; the bubble point at 10 Bar is at approximately −126° C. This means that as long as the liquid is colder than −126° C., no gasification occurs as long as the LNG remains at or above this pressure. After circulating for some time, equilibrium conditions will be achieved within the closed loop and the liquid LNG will be returned to the inlet of pump 55 in tank 42 at a pressure and temperature represented by Point E on the graph in FIG. 5; e.g. 5 Bar and −140° C. (Point E in FIG. 5 is selected only for illustrating the concept of the present invention). The state of LNG and the location the actual Points on the graph will be determined by a particular application). The LNG is now pressurized to a relatively high pressure (e.g. 10 bar) at the outlet of pump 55 (Point F). However, this raising of the LNG pressure also results in a rise in its temperature; (e.g. −136° C.).

This pressurized and heated LNG is then passed through heat exchanger 58 to thereby cool it to Point G; e.g. the temperature of LNG in the tank (e.g. −160° C.) before the LNG enters line 44 and flows through the closed circulation loop. After the LNG has completed a cycle through the closed loop, it returns to the surface of the LNG in tank 42 at a temperature and pressure represented by Point H on the graph of FIG. 5 which is well above the bubble point curve 30. Once the returning LNG contacts the LNG in the storage tank 42, it is again cooled slightly by the LNG in tank to Point E (FIG. 5) before it again enters the inlet of pump 55 in the closed loop circulation pattern.

When properly designed for a particular application, the supercooled, pressurized LNG will continue to (a) flow through the circulation loop, (b) loose pressure due to pipe friction and other causes, (b) gain heat due to natural heat in-leak processes and (d) return to the inlet of pump 55 as a single phase liquid. These features result in several significant improvements. First, the heat flow into the transfer lines will be reduced since there will be a smaller temperature differential between the ambient temperature and that in the higher (cryogenic) temperature in the transfer lines; i.e. the lines are operating at warmer temperature (e.g. −140° C. instead of −160° C. in a conventional, open-loop operation).

Second, there will be only a single phase flow regime throughout the transfer system since the supercooled LNG has large capacity to absorb gas before reaching its bubble point. Third, smaller inputs of pumping energy are required due to single phase flow regime and reduced heat flow into the lines; this, by itself, substantially reducing boil-off of the LNG within the system. In the closed loop system of the present invention, all the boil-off is generated at the heat exchanger inside the tank during idle intervals, instead of in the transfer lines as in conventional systems.

First circulating pump 55 continues to pressurize LNG and circulate it through the closed loop after it passes through heat exchanger 58. This circulation is continued during most of an idle interval between transfer operations to keep the transfer lines cool and the circulating LNG in a single phase, i.e. liquid. A short period of time (e.g. two to three hours) before the next transfer operation, the temperature in the transfer system 40 is further reduced to the operating temperature normally used in conventional operations. This added cooling is achieved by shutting down first circulation pump 55, closing valves 56, 58*a*, opening valves 50 and 64 and starting second low backpressure, high flow circulating pump 60. Pump 60 pumps LNG through the now open loop in a conventional manner at a relative low pressure (e.g. 1 bar) and a high flow rate which cools the lines to the desired temperature in readiness for the next transfer operation.

What is claimed is:

1. A system for transferring cryogenic fluids between a first point and a second point including means for cooling said system when no cryogenic fluids are being transferred; said system comprising;

a first transfer line extending between said first point and said second point, said first transfer line having a first end terminating at said first point any a second end terminating at said second end;

a second transfer line extending between said first point and said second point, said second transfer line having a first end terminating at said first point and a second end terminating at said second point;

a conduit fluidly connecting said first, end of said first transfer line to said first end of said second transfer line;

an inlet line fluidly connected to said conduit at one end and adapted to be connected at its other end to a transfer pump at said first point;

a valve in said inlet line for opening and closing said inlet line;

a first circulation pump at said second point having an inlet fluidly connected to one of said first or said second transfer lines and having an outlet fluidly connected to the other of said first or said second transfer lines whereby a circulating cryogenic fluid can be circulated by said first circulation pump through a closed loop formed by said first transfer line and said second transfer line, said conduit, and said first pump to thereby cool said transfer lines when said system is not in use.

2. The system of claim 1 including:

a heat exchanger fluidly connected between said outlet of said first circulation pump and said other of said first or said second transfer lines for cooling said circulating cryogenic fluid after it has passed through said first circulation pump.

3. The system of claim 2 wherein said first point comprises:

a first tank for storing cryogenic fluids; and wherein said second point comprises:

a second tank for storing cryogenic fluids.

4. The system of claim 1 wherein said first circulation pump comprises:

a high backpressure, low flow rate pump.

5. The system of claim 3 wherein said heat exchanger is positioned within said second tank and in contact with cryogenic fluid stored therein.

6. The system of claim 3 including:

a second circulation pump at said second point having an inlet adapted to receive cryogenic fluid from within said second tank and having an outlet fluidly connected to the one of said first or said second transfer lines whereby a circulating cryogenic fluid can be circulated by said second circulation pump through an open loop formed by said first transfer line and said second transfer line, said conduit, and said second pump to thereby further cool said transfer lines prior to commencement of a transfer operation.

7. The system of claim 6 including:

first valve means in said first transfer line to open and close flow through said second end of said first transfer line to allow cryogenic fluids from said first transfer line to flow into said second tank when said first valve means is open; and valve means in said second transfer line to open and close flow through said second end of said second transfer line to allow cryogenic fluids from said second transfer line to flow into said second tank when said valve means is open.

8. A method of cooling a transfer system which is used for transferring cryogenic fluids between a first point and a second point when said system is not in use wherein said system comprises two transfer lines which extend between said first point and said second point, said method comprising:

fluidly connecting the respective ends of said first and a second transfer lines together to form a closed loop when said system is not in use;

circulating a pressurized, cryogenic fluid through said closed loop to cool and maintain the temperature of said first and said second transfer lines at a temperature at which said cryogenic fluid will remain in its liquid phase.

9. The method of claim 8 wherein said cryogenic fluid is pressurized and circulated by passing said cryogenic fluid through a high backpressure, low flow rate pump within said closed loop.

10. The method of claim 9 including:

cooling said pressurized, cryogenic fluid after it has passed through said pump.

11. The method of claim 10 wherein said first point is a first tank for storing cryogenic fluid and said second point is a second tank for storing cryogenic fluid and wherein said pressurized cryogenic fluid is cooled by passing it through a heat exchanger positioned within said second tank.

12. The method of claim 11 wherein said cryogenic fluid is liquefied natural gas.

13. The method of claim 12 including:

ceasing circulation through said closed loop; and circulating cryogenic fluid from second tank through said first and said second transfer lines at a and a high flow rate and a low pressure.

* * * * *